US007042330B2

(12) United States Patent
Nakamura et al.

(10) Patent No.: US 7,042,330 B2
(45) Date of Patent: May 9, 2006

(54) LOW RESISTANCE VALUE RESISTOR

(75) Inventors: Keishi Nakamura, Nagano (JP); Mikio Tatuguchi, Nagano (JP)

(73) Assignee: KOA Corporation, Ina (JP)

( * ) Notice: Subject to any disclaimer, the term of this patent is extended or adjusted under 35 U.S.C. 154(b) by 0 days.

(21) Appl. No.: 10/823,666

(22) Filed: Apr. 14, 2004

(65) Prior Publication Data

US 2004/0196139 A1 Oct. 7, 2004

Related U.S. Application Data

(63) Continuation of application No. 09/825,446, filed on Apr. 4, 2001, now Pat. No. 6,794,985.

(30) Foreign Application Priority Data

| | | |
|---|---|---|
| Apr. 4, 2000 | (JP) | 2000-102616 |
| Nov. 9, 2000 | (JP) | 2000-342198 |
| Dec. 14, 2000 | (JP) | 2000-380723 |
| Mar. 7, 2001 | (JP) | 2001-063955 |

(51) Int. Cl.
*H01C 1/12* (2006.01)

(52) U.S. Cl. ..... 338/309; 338/254; 338/322; 338/325

(58) Field of Classification Search ..... 338/49, 338/57, 195, 206, 207, 210, 254, 309, 322, 338/329

See application file for complete search history.

(56) References Cited

U.S. PATENT DOCUMENTS

| | | | | |
|---|---|---|---|---|
| 2,407,251 A | | 9/1946 | Christensen | 338/325 |
| 2,745,931 A | | 5/1956 | Heibel | 338/309 |
| 3,245,021 A | * | 4/1966 | Kernander et al. | 338/49 |
| 3,525,065 A | | 8/1970 | Person | 338/254 |
| 3,654,580 A | | 4/1972 | Laisi | 338/61 |
| 3,959,763 A | | 5/1976 | Sibley et al. | 338/20 |
| 4,083,029 A | | 4/1978 | Lahiri | 338/32 S |
| 4,529,958 A | | 7/1985 | Person et al. | |
| 4,580,095 A | | 4/1986 | Vries | 324/126 |
| 4,803,345 A | | 2/1989 | Hoshizaki et al. | 219/553 |
| 4,829,553 A | | 5/1989 | Shindo et al. | 338/309 |
| 4,912,974 A | | 4/1990 | Inada et al. | 73/204.25 |
| 4,991,059 A | | 2/1991 | Kiyose | 361/773 |
| 5,111,002 A | | 5/1992 | Hollander | |
| 5,214,407 A | | 5/1993 | McKim, Jr. et al. | 338/49 |
| 5,218,334 A | | 6/1993 | Bartlett | 338/61 |
| 5,287,083 A | | 2/1994 | Person et al. | 338/332 |
| 5,573,692 A | | 11/1996 | Das et al. | 219/543 |
| 5,604,477 A | | 2/1997 | Rainer et al. | 338/293 |

(Continued)

FOREIGN PATENT DOCUMENTS

| | | |
|---|---|---|
| JP | 2-77101 | 3/1990 |

(Continued)

*Primary Examiner*—Tu Hoang
(74) *Attorney, Agent, or Firm*—Armstrong, Kratz, Quintos, Hanson & Brooks, LLP

(57) ABSTRACT

The low resistance value resistor 11 has two electrodes 12,13 of metal strips having a high electrical conductivity. The metal strips are affixed on the resistor body by means of rolling and/or thermal diffusion bonding. A fused solder layer is formed on a surface of each electrode comprised by the metal strip. Thus, sufficient bonding strength and superior current distribution in the resistor body is obtained. Further, a portion of the resistor body is trimmed by removing a portion of the body material along a direction of current flow between the electrodes to adjust a resistance value. Thus, a precise resistor value and superior characteristics of temperature coefficient of resistance (TCR) can be obtained.

5 Claims, 4 Drawing Sheets

U.S. PATENT DOCUMENTS

| | | | | |
|---|---|---|---|---|
| 5,929,746 | A | 7/1999 | Edwards, Jr. et al. | 338/320 |
| 5,999,085 | A | 12/1999 | Szwarc et al. | 338/309 |
| 6,005,474 | A | 12/1999 | Takeuchi et al. | 338/320 |
| 6,148,502 | A | 11/2000 | Gerber et al. | 29/621 |
| 6,181,234 | B1 | 1/2001 | Szwarc et al. | 338/53 |
| 6,194,990 | B1 | 2/2001 | Lee et al. | 338/320 |
| 6,433,666 | B1 | 8/2002 | Inoue et al. | 338/22 R |
| 6,441,718 | B1 | 8/2002 | Smejkal et al. | 338/329 |
| 6,801,118 | B1 * | 10/2004 | Ikemoto et al. | 338/307 |
| 6,816,056 | B1 * | 11/2004 | Ikemoto et al. | 338/307 |

FOREIGN PATENT DOCUMENTS

| | | | |
|---|---|---|---|
| JP | 06-224014 | | 8/1994 |
| JP | 08-236324 | | 9/1996 |
| JP | 2000-91103 | * | 3/2000 |

* cited by examiner

LOW RESISTANCE VALUE RESISTOR

CROSS REFERENCE TO RELATED APPLICATION

This application is a continuation of Ser. No. 09/825,446, filed Apr. 4, 2001 now U.S. Pat. No. 6,794,985.

BACKGROUND OF THE INVENTION

1. Field of the Invention

The present invention relates to a low resistance value resistor suitable for use in applications such as current detector and the like, and relates in particular to a resistor made of a resistive alloy and having an electrode placed at each end of the resistor body.

2. Description of the Related Art

Low resistance value resistors of a plate- or ribbon-shape having an electrode placed at each end of a metallic base material are widely used in applications such as current detector and the like because of their characteristics of good heat dissipation and high current carrying capacity. Metallic materials serving as a resistor body include, for example, copper-nickel alloys, nichrome alloys, iron-chromium alloys and manganese alloys, and an electrode is placed at each end of the resistor. Conventional electrode structures are generally based on electroplated electrode on a metallic material mentioned above.

However, it is difficult to form a thick deposit on the resistor body by electroplating, and for this reason, uniformity of electric potential through the electrode is low, and the current path can not be stabilized, thereby making it difficult to manufacture low resistance value resistors of high precision. Also, bonding between the metallic material constituting the resistor body and the electrode produced by electroplating is weak, and problems occur when it is necessary to bend the resistor body for use, because the bond is susceptible to mechanical, thermal and electrical stresses.

Also, in some low resistance value resistors, instead of electroplated electrodes, electrodes are sometimes made by affixing a strip of copper or nickel to the resistor body by means of electron beam welding and the like. Even in such cases, such spot-type joining techniques produce small areas of contact through the attached strip, and similar problems of insufficient bonding strength and non-uniformity of current distribution are created. Therefore, problems are encountered in attaining high precision in low resistance value resistors, and obtaining low values of the temperature coefficient of resistance (TCR).

SUMMARY OF THE INVENTION

The present invention is provided in view of the background information described above and an object is to provide a low resistance value resistor that has a bonding strength sufficiently high for mechanical applications, a precise resistor value and superior characteristics of temperature coefficient of resistance (TCR).

The low resistance value resistor of the present invention is comprised by: a resistor body comprised by a resistive alloy; at least two electrodes, comprised by metal strips having a high electrical conductivity, formed separately on one surface of the resistor body; such that the metal strips are affixed on the resistor body by means of rolling and/or thermal diffusion bonding.

The low resistance value resistor is made by bonding metal strips on both ends of the resistor body having a high electrical conductivity by means of rolling and/or (thermal) diffusion bonding. In comparison with the electrodes made by electroplating or welding, the metal strip affixed by such rolling and/or diffusion bonding processes forms a diffusion layer at the interface of the metallic material of the resistor body or in the interior the resistor body. Therefore, because of the presence of the diffusion layer, the electrode are bonded strongly to the resistor body and a uniform distribution of current is obtained. The electrode structure thus produced is stable and is resistant to various stresses, including mechanical, thermal and electrical stresses.

Another aspect of the resistor is that a fused solder layer is formed on a surface of each electrode comprised by a metal strip.

Although the fused solder layer formed on the surface of the metal body is very thin, of the order of several micrometers, but the fused solder layer diffuses into the metallic material. For this reason, because of the presence of the fused solder layer diffusing into the interior of the metallic material, a high bonding strength is obtained and uniform current distribution is enabled. Therefore, as noted above, the electrode structure thus produced is stable and is resistant to various stresses, including mechanical, thermal and electrical stresses.

Still another aspect of the resistor is that the resistor body is trimmed by removing a portion of the body material along a direction of current flow to obtain a precisely controlled resistance value. Trimming to adjust a resistance value is performed by removing a portion of the body material in a thickness direction or along a corner section.

According to the present invention, a portion of the resistor body removed by a trimming process extends along the path of current flow so that the direction of the current flow in the trimmed resistor body is hardly affected by the removal of the portion. That is, as shown in FIG. 7 of the conventional low resistance value resistor, laser trimming is applied at right angles to the current flow to produce cutouts 1300, so that the direction of the current flow in the trimmed resistor is altered considerably, because the current must detour around the cutouts. Such a change in the current distribution created a problem that variations in the value of resistance are encountered in life testing and other tests. According to the present method of trimming, the resistance value is not changed in the life testing and other tests after the resistance trimming is performed. Because the current distribution is hardly affected and the current flows uniformly through the resistor body, thus there is no problem of variations in the resistance value of a trimmed resistor.

DETAILED DESCRIPTION OF THE PREFERRED EMBODIMENTS

Figure 1:
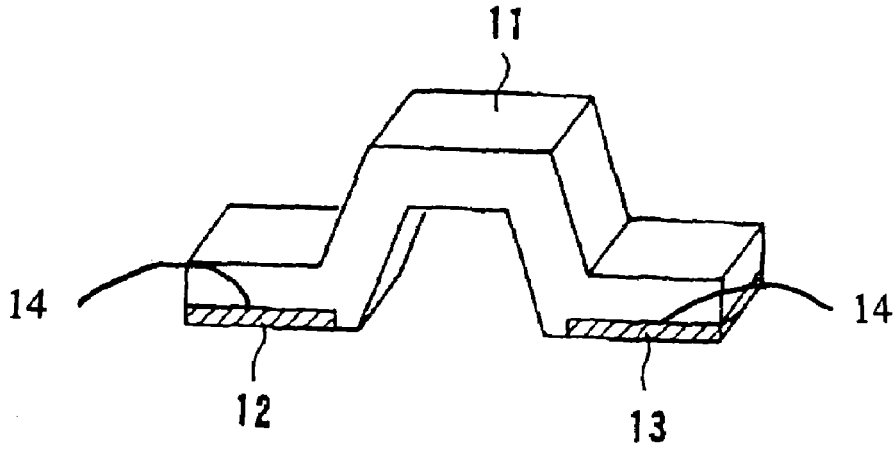
FIG. 1 is a perspective view of a low resistance value resistor in a first embodiment of the present invention.

Preferred embodiments will be explained in the following with reference to the drawings. FIG. 1 shows an example of the structure of a low resistance value resistor in a first embodiment. As shown in the diagram, the resistor is provided with a metal strip members 12, 13 bonded to each end of the metal (base material) 11, serving as the resistor body, by means of (thermal) diffusion bonding and the like. In this example of the structure, the metal strip members 12, 13 are inlaid in the metal base 11, producing the so-called inlay cladding structure. Here, the base material preferably includes copper-nickel alloys, nichrome alloys or iron chromium alloys. The metal strip members having a thickness of about 50 to 200 μm are made of copper or nickel and are bonded to the base material by rolling and/or thermal diffusion bonding.

The low resistance value resistor has an extended length of about 20 mm or less, for example, width of about 5 mm, and the metal strip members are bonded so as to be about 2.5 mm away from the inside end of the resistor body. The base material has a thickness of about 150 to 600 μm. Such a shape produces a resistance of several mΩ to several tens of mΩ. It should be noted that, although this embodiment is based on the inlay cladding structure having inlaid strip member produced by rolling and/or thermal diffusion bonding, but the low resistance value resistor may also be made in the so-called top-lay cladding structure produced by placing the metal strips on the base material and bonding the metal strips to the base material by rolling and/or thermal diffusion bonding of the metal strips to the base material.

A low resistance value resistor having such a structure is made by preparing a metallic material serving as the base material, and, bonding the metal strips on both ends of the metallic base material by rolling and/or thermal diffusion bonding. Rolling and/or thermal diffusion bonding are carried out by applying heat to maintain a specific temperature and applying pressure. By so doing, a diffusion layer is formed by diffusion of the material from the metal strip to the bond interface or into the interior of the base material. After the bonding step, the bonded material is cut into pieces of a suitable length, and is bent in the shape shown in FIG. 1. In the case of the inlay cladding structure, it is necessary to pre-fabricate grooves 14 in the base material for inlaying the metal strips 12 and 13.

The low resistance value resistor thus manufactured does not present any problem of cracking or peeling of electrodes during bend forming of the resistor to produce a shape illustrated in FIG. 1, because the electrode section produced by rolling and/or thermal diffusion bonding has sufficient mechanical strength to withstand bending stresses. Also, because the distribution of current in the electrode is uniform, a low resistance value resistor of superior electrical properties can be produced. Therefore, when the resistor is installed on a printed circuit board, it is resistant to various kinds of stresses that may be applied during the installation processes, because of its superior mechanical, thermal and electrical strengths, and the time-dependent changes in the properties can be held to a minimum.

Figure 2:
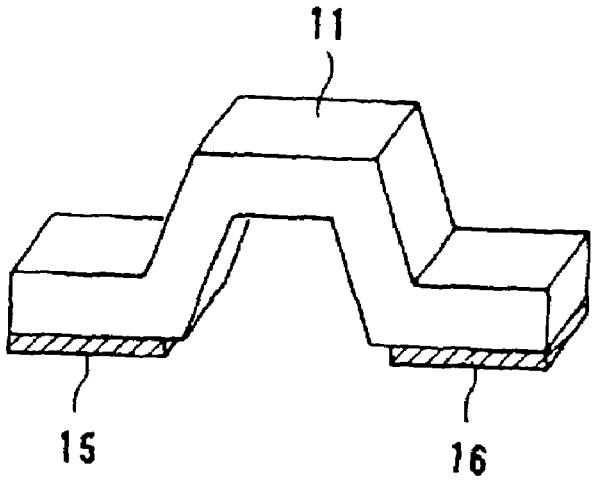
FIG. 2 is a perspective view of a low resistance value resistor in another example of the resistor in the first embodiment.

FIG. 2 shows another example of the resistor structure in the first embodiment. The metallic material of the resistor serving as the base material is essentially the same as that in the first embodiment, and includes copper nickel alloys, nichrome alloys and manganese alloys. Electrodes 15, 16 having a fused solder layer on its surfaces are provided on both ends of the metallic material 11 serving as the resistor body. The fused solder layer is formed by diffusing the fused solder into the surface of the metal strip serving as the electrode, and the thickness of the fused solder layer on the surface is only of the order of about several micrometers. Comparing with the conventional electroplated or welded electrode structure, the diffusion layer of the fused solder exists within the interface and in the interior of the electrode, so that the electrode structure is superior with respect to its mechanical strength and current stability characteristics.

And, although the layer thickness is only of the order of several micrometers, accordingly, the layer has an excellent resistance to bending damage, and the diffused layer produces significantly lower electrical resistance. Further, it is expected that the present resistor would provide superior temperature coefficient of resistance (TCR) compared with the conventional resistors having an electrode structure comprised by welded copper strip or electroplated film. For example, changes in the resistance within a given time period for electroplated electrode are about 0.5–2.0%, but compared with these values, changes in the fused solder layered electrode over the same time periods is significantly lower at 0–0.1%. With respect to TCR, it is 4000–5000 ppm/° C. for copper materials while it is about 2000 ppm/° C. for fused solder layered electrodes.

Further, by using the fused solder layer electrode, soldering with a solder not containing any lead is facilitated. In other words, when mounting the resistor on printed circuit board and the like, various solders can be used to mount the resistor using solders not containing any lead. Accordingly, the electrode structure is highly compatible with various environmental concerns.

It should be noted in the above examples that the shapes and dimensions of the low resistance value resistor described above are only examples, and it is obvious that various modifications are possible within the essence of the present structure of the low resistance value resistor.

Figure 3A:
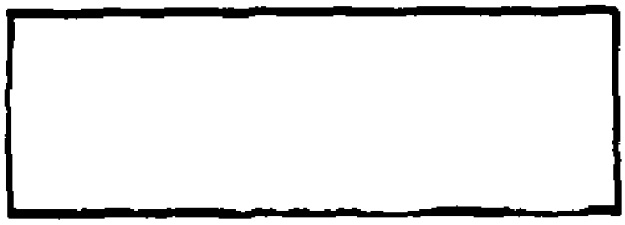
FIGS. 3A–3C are diagrams to explain a method of trimming the resistor in the present invention.
Figure 3B:
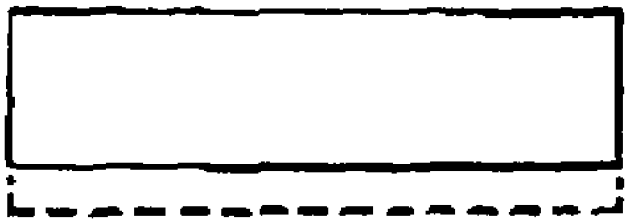
Figure 3C:
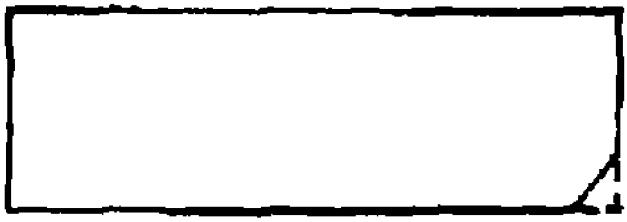

Next, trimming of the resistance value of the resistor will be explained with reference to FIGS. 3A–3C. Trimming is carried out by removing a portion of the material from the resistor body along the direction parallel to the flow of electrical current through the resistor body. FIG. 3A shows a cross sectional view at right angles to the flow of current. As shown in FIG. 3B, trimming may be carried out by shaving a portion of the resistor body in the thickness direction along the direction parallel to the flow of current. Trimming may also be carried out, as shown in FIG. 3C, by removing an edge portion of the resistor body along the direction parallel to the flow of current. That is, the edges may be removed. Such fabrication of the resistor body may be performed using mechanical grinding, laser or etching fabrication. Such a method of removing the material from the resistor body in the direction parallel to the current flow essentially prevents introducing changes in the post-trimming current distribution. Therefore, if the resistance value is adjusted by trimming at a 1% precision, the value of the resistance is hardly affected after life testing, and the degree of precision of the resistor is retained.

Next, a second embodiment of the low resistance value resistor will be explained.

Figure 4:
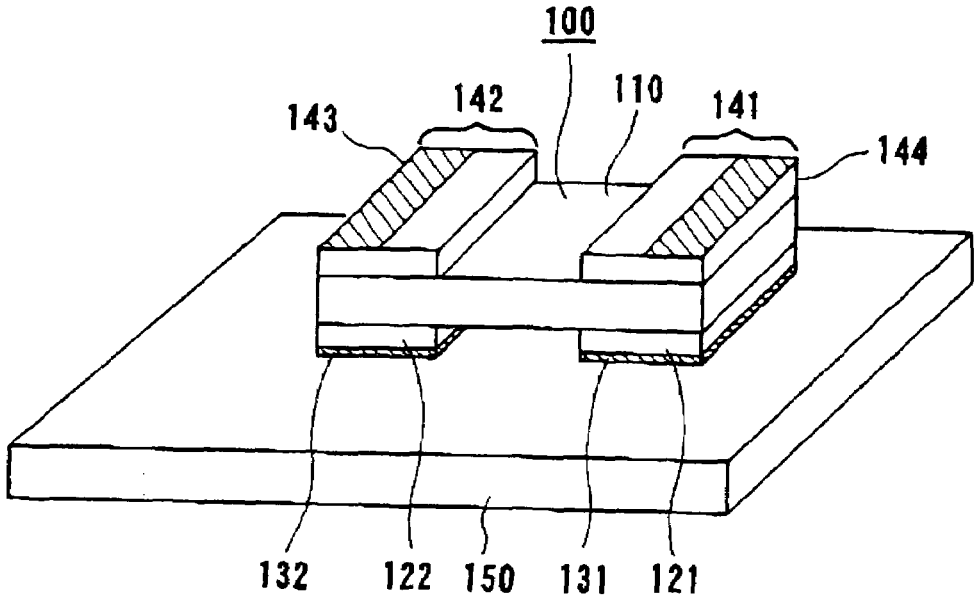
FIG. 4 is a perspective view of a low resistance value resistor in a second embodiment of the present invention.

FIG. 4 shows a low resistance value resistor 100 in the second embodiment, which is solder mounted to conductor patterns on a substrate base 150.

The resistor 100 is comprised by a metallic resistor body 110; electrodes 121, 122 serving as connecting terminals; and bonding electrodes 141, 142. The resistor 100 is constructed by two electrodes 121, 122 of a tetragonal shape and two bonding electrodes 141, 142 of a tetragonal shape, which are bonded to one resistor body 110 of a tetragonal shape, as shown in FIG. 4.

Voltage measurement using the low resistance value resistor 100 is carried out by connecting the conductor patterns of the substrate base 150 and the electrodes 121, 122, and connecting bonding-wires to the bonding electrodes 141, 142 by bonding means and the like so as to enable a voltage drop between the bonding electrodes 141, 142 to be measured. As shown in FIG. 4, preferable bonding position 143, 144 are provided on the lateral outer side of the respective center lines of the bonding electrodes 141, 142 for ease of attaching measuring bonding wires.

The thickness $t_R$ of the resistor body 110 is about 50–2000 μm, and the thickness $t_E$ of the electrodes 121, 122 is about 10–500 μm, and the ratio of the thickness of the electrode 121 to the thickness of the resistor body 110 is designed so that $t_E/t_R>1/10$. Also, the thickness of the bonding electrodes 141, 142 is about 10–100 μm, and a solder layer of 2–10 μm thickness (fused solder layer, for example) is provided on the surface of each of the electrodes 121, 122.

The resistor 100 is designed so as to dissipate heat easily, and the substrate base 150 to be mounted on a printed circuit board is made of aluminum and the base 150 itself is bonded to the heat sink and the like.

That is, the heat generated when high current measurements are performed is conducted towards the substrate base 150 so that the contact interface between the resistor 100 and the substrate base 150 is important. Therefore, a feature of the resistor 100 is that a highly thermally conductive copper plate of some thickness is used at the bonding interface of the electrodes 121, 122 and the substrate base 150 and the joint area is made large. The electrodes 121, 122 are affixed to the resistor body 110 by means of rolling and/or thermal diffusion bonding.

The current for high precision voltage measurements flows from the conductor patterns of the substrate base 150 to the resistor body 110 through one electrode 121 of the resistor 100, and flows from the resistor body 110 to other electrode 122 of the resistor body 110. A voltage drop is measured between the two ends of the resistor 100, i.e., when a high current is passed between the two electrodes, by connecting the bonding electrodes 141, 142 to patterns of the substrate base 150 by using aluminum wires and the like. It should be noted that the bonding electrodes 141, 142 are bonded (i.e., conductive) to the resistor body 110 to improve the precision of the voltage drop. Therefore, the low resistance value resistor 100 having the structure shown in FIG. 4 can be used for high current flow situations.

The material for the resistor body 110 includes, for example, various metal alloys such as, Cu—Ni alloys (CN49R, for example), iron-chromium alloys, manganese-copper-nickel alloys, platinum-palladium-silver alloys, gold-silver alloys, and gold-platinum-silver alloys as well as various noble metal alloys. These materials are selected according to required resistance value, resistivity, TCR, resistance value changes and other such characteristics to suit various applications.

Also, a resistor body 110 of extremely low value of resistance can be produced when a noble metal alloy having a resistivity of about 2–7 μΩ·cm is used. For example, when such a noble metal alloy is used as the resistor body 110, the resistance value of the resistor 100 having the structure shown in FIG. 4 is about 0.04–0.15 mΩ.

The material for forming the electrodes 121, 122 includes copper materials that are lower in resistivity than the resistor body 110 (for example, resistivity 1.6 μ∩·cm), such that the resistor body 110 and the electrode 121 or the resistor body 110 and the electrode 122 are bonded by rolling and/or thermal diffusion bonding, i.e., clad bonded.

Here, the electrode material used for forming the electrode 121 or 122 and the resistor body material used for forming the resistor body 110 should conform to a relation defined below in terms of their resistivity values, such that it is preferable that:

electrode material resistivity/resistor body resistivity=(1/150)–(1/2)

be satisfied.

The material for forming the bonding electrodes 141, 142 includes nickel materials (for example, about 6.8 μΩ·cm) or aluminum materials (for example, about 2.6 μΩ·cm) or gold materials (for example, about 2.0 μΩ·cm). The surfaces of the two electrodes 121, 122 are designed to have a wide electrode area so as to facilitate dissipating the heat generated when measuring high current signals, by directing the heat towards the substrate base 150. A metallic material of good thermal conductivity is suitable, and the bonded area should be made large.

Also, layers 131, 132 made of a fused solder material (Sn:Pb=9:1) or a lead-free fused solder material are formed on the surfaces of the electrodes 121, 122 to improve bonding to the conductor circuit patterns on the substrate base 150. By using a fused solder material, a diffused solder layer is formed at the interface between the conductor circuit pattern on the substrate base 150 and the electrode 121 or 122 so that the bonding strength of the electrode is increased, and further the electrical reliability is also improved.

Figure 7:
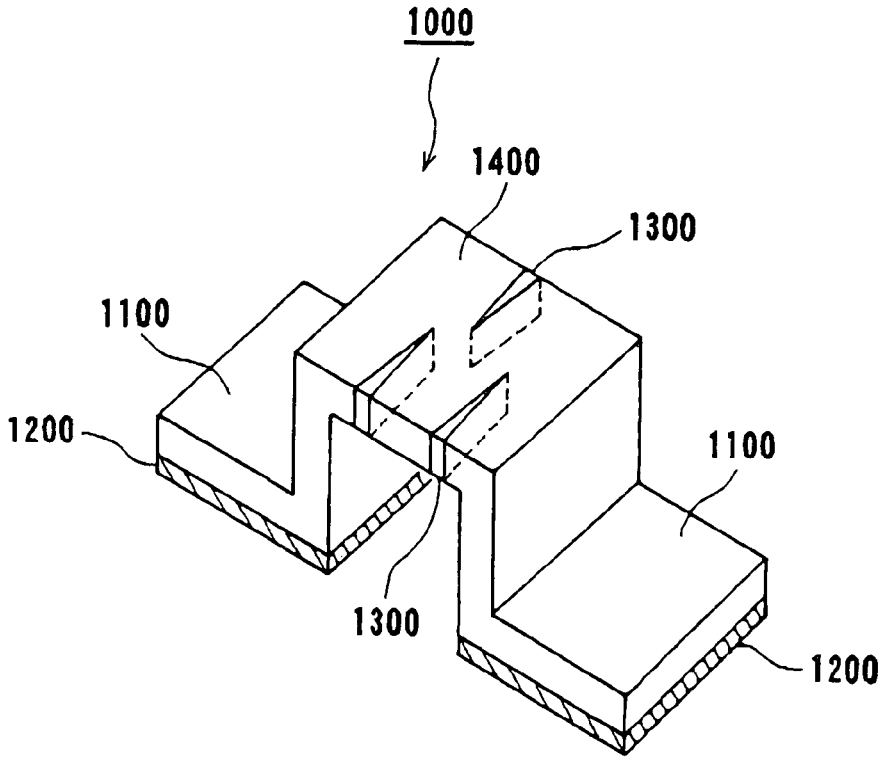
FIG. 7 (Prior Art)
FIG. 7 is a perspective view of a conventional low resistance value resistor.

A feature of the resistor 100 is that the resistor body 110 has a simple structure comprised by plates so that there are no cutouts 1300 shown in FIG. 7 formed in the resistor 1000 for conventional current detectors. However, the resistance value of the resistor can be precisely adjusted by trimming that removes a portion of the body material along a direction of current flow.

Specifically, resistance value of the resistor 100 is adjusted or trimmed by varying the thickness of the plate of the resistor body 110 (thickness of the resistor body 110 exposed on the electrode side upper surface and the electrode side lower surface of the resistor 100 in FIG. 4). Methods for adjusting the thickness of the resistor body 110 include shaving the material by grinding, laser, sand blasting, etching or so on, and the thickness is adjusted so that the resistor 100 would have a specific resistance value by using any of such methods. When adjusting the thickness of the resistor body 110, either the upper or lower surface of the resistor body 110 or both surfaces may be shaved by using any of the method mentioned above.

Because there is no cutouts in the resistor body 110 of the resistor 100, the current path in the resistor 100 is made stable, so that changes in resistance can be reduced to a level of (1/several tens) to (1/200) compared with changes that take place in cutouts trimmed resistors.

Also, when noble metal alloys which have very low resistivity in a range of 2–7 μΩ·cm is used for the resistor body 110, the resistance value of the resistor 100 becomes about 0.04–0.15 mΩ so that a resistor suitable for measuring high current is obtained.

When boding measuring wires to the bonding electrodes 141, 142, wires should be attached to locations towards the outer lateral side beyond the respective center lines of the left and right bonding electrodes 141, 142 so as to minimize voltage fluctuations.

A third embodiment will be explained with reference to FIG. 5.

Figure 5:
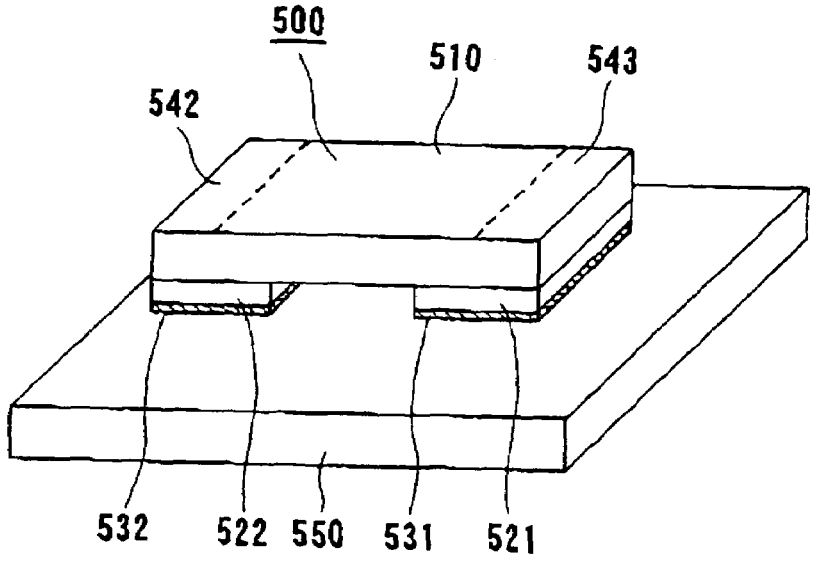
FIG. 5 is a perspective view of a low resistance value resistor in a third embodiment of the present invention.

FIG. 5 shows a resistor 500 in the third embodiment mounted on the conductor pattern of the substrate base 550. The resistor 500 is comprised by a resistor body 510 made of a metallic material and electrodes 521, 522 serving as the contact terminals.

To perform voltage measurements using the resistor 500, the conductor pattern on the substrate base 550 and the electrodes 521, 522 are connected, wires are connected to wire sites 542, 543, shown in FIG. 5, by wire bonding means, for example, and a voltage drop between the wire sites 542, 543 is measured. The width of the wire sites 542, 543 is ½ of the distance of the electrodes 521, 522, and the sites are formed where the locations are suitable for connecting wires. It should be noted that, in the above explanation, wire bonding was used as an example of obtaining a connection for measuring voltage drop therebetween, but a voltage drop can be measured without using wire bonding, by obtaining the land pattern for voltage measurements from the substrate land pattern.

The resistor 500 is constructed by having two tetragonal shaped electrodes 521 placed at both ends of the tetragonal shaped resistor body 510. The thickness $t_R$ of the resistor body 510 is about 50–2000 μm, for example, and the ratio of the thickness $t_E$ of the electrodes 521, 522 and the thickness $t_R$ of the resistor body 510 is such that $t_E/t_R>1/10$. Also, fused solder layer 531, 532 having a thickness of about 2–10 μm are provided, respectively, on the surface of respective electrodes 521,522. Also, the resistor is trimmed to have high precision of resistance value by adjusting the thickness of the resistor body by shaving thereof and the like.

A fourth embodiment will be explained with reference to FIG. 6.

Figure 6:
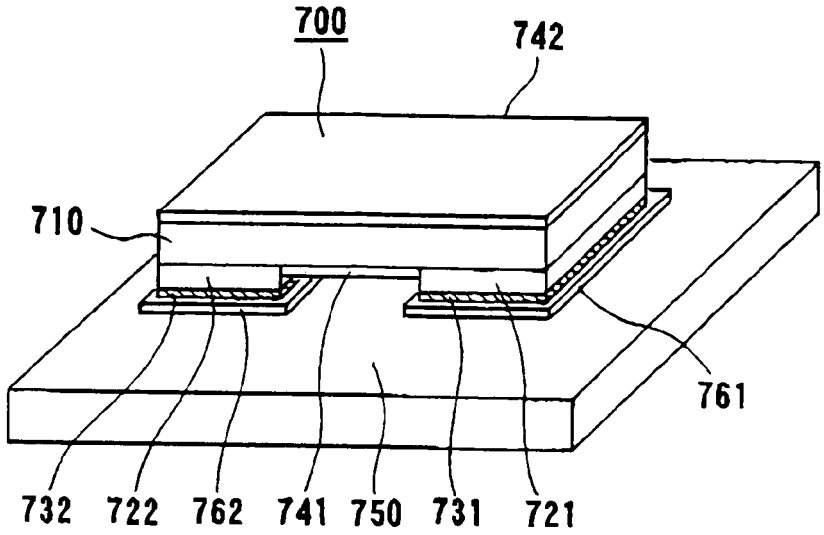
FIG. 6 is a perspective view of a low resistance value resistor in a fourth embodiment of the present invention.

FIG. 6 shows a resistor 700 of the embodiment mounted on the conductor circuit patterns 761, 762 formed on the substrate base 750. The resistor 700 is comprised by a metallic resistor body 710, electrodes 721, 722 serving as the connection terminals and insulation layers 741, 742.

The resistor 700 is constructed by tetragonal shaped electrodes 721, 722 bonded at both ends on the tetragonal shaped resistor body 710, and further, insulation layers 741, 742 covered by an insulation material having a high resistance than the resistor 700 is formed on the upper and lower surfaces 741, 742 of the resistor body 710.

The thickness of the resistor body is about 100–1000 μm, the thicknesses of the electrodes 721, 722 are about 10–300 μm, and the thicknesses of the insulation layers 741, 742 are about several to several tens of micrometers. Also, a fused solder layer of about 2–10 μm is formed on the surface of the electrodes 721, 722.

The material for forming the resistor body 710 includes, for example, copper-nickel alloys, nickel-chromium alloys, iron-chromium alloys, manganese-copper-nickel alloys, platinum-palladium-silver alloys, gold-silver alloys, and gold-platinum-silver alloys, which may be suitably selected and used.

Also, as shown in FIG. 6, when noble metal alloys which have very low resistivity is used, the resistor body 710 having an electrical resistance in a range of about 2–7 μΩ·cm is obtained, and for example, when using such a noble metal as the resistor body 710, the resistance value of the resistor 700 shown in FIG. 6 becomes about 0.04–0.15 mΩ.

The material for forming the electrodes 721, 722 includes copper materials that are lower in electrical resistance than the resistor body 710 (for example, about 1.5 μΩ·cm), such that the resistor body 710 and the electrode 721 or the resistor body 710 and the electrode 722 are bonded by rolling and/or thermal diffusion bonding, i.e., clad bonded. The surfaces of the two electrodes 721, 722 are designed to have a large surface area so as to dissipate heat generated during high current flow by conducting heat towards the substrate base 750. Copper plate of high thermal conductivity and having some thickness should be used, and the bonding surface area should be made large. Also, the resistor is trimmed to have high precision of resistance value by adjusting the thickness of the resistor body 710 by shaving thereof and the like.

The insulation layer 741, 742 may be formed by coating an insulation material having a resistivity higher than the resistor body 710, or by adhering a tape made of such an insulative material on the resistor body 710. Here, it should be noted that the insulation layer need not be limited to the upper and lower surfaces 741, 742 of the resistor body 710, so that it may be applied, as necessary, to the side surfaces of the resistor body shown in FIG. 6.

The material for forming the insulation layer includes various resin materials that are electrically insulative. For example, resins include epoxy resins, acrylic resins, fluorine resins, phenol resins, silicone resins, and polyimide resins, which can be used independently or by mixing therewith. Also, instead of the resin materials mentioned above, any thermally resistant materials that are electrically insulative may be used.

When such resin materials are used, a resin should be dissolved in a solvent and applied to specific locations of the resistor body 710 by printing techniques and the like. Or, instead of applying a resin coating, an adhesive tape made of the resin material may be bonded to specific locations on the resistor body 710 to cover the resistor body with an insulation layer.

Also, a fused solder layer (Sn:Pb=9:1) or a lead-free fused solder layer 731,732 is formed on the surface of the electrodes 721, 722 to improve bonding to the conductor patterns on the substrate base. By using the fused solder layer, a diffusion layer is formed at the interface between the conductor pattern on the substrate base and the electrode 721 or 722 so that the bonding strength of the electrode is increased, and further the electrical reliability is improved.

There are two reasons described below for forming the insulation layers 741, 742 on the resistor body 710.

The first reason is to improve the yield of the products in production stage. That is, when mounting the resistor 700 on a substrate base to measure the current flowing through the resistor, if there is no insulation layer 741, resistance value can be changed sometimes by the solder rising to the resistor section 710 of the resistor 700 during mounting the resistor 700.

For example, when mounting the resistor 700 on the conductor circuit patterns 761, 762 of the substrate base 750, after forming the fused solder layer or fused lead-free solder layer 731, 732 on the surfaces of the electrodes 721, 722 in the mounting step, the resistor 700 is bonded to the specific parts on the conductor circuit patterns 761, 762 of the substrate base 750.

If the solder layer 731, 732 melts during mounting of the resistor 700 on the substrate base 750, molten solder material can rise to attach to the surface of the resistor body 710, resulting in a change in the value of the resistance of the resistor 700, so that the precisely controlled resistance value cannot be obtained.

However, if the insulation layer 741 is formed on the surface of the resistor body 710 beforehand as shown in FIG. 6, the resistance value is not changed even if molten solder material adheres to the insulation layer 741 provided on the surface of the resistor body 710.

The result is that the strict rules governing the design of the land patterns can be eased, compared with the case of not having the insulation layer 741 on the surface of the resistor body 710, or it is not necessary to rigidly manage the amount of solder required for the soldering process and adjustment of solder times, so that the task of soldering is facilitated to contribute to improving the production yield. Therefore, in order to improve the yield of producing the resistor 700, it is effective to form an insulation layer on the surface 741 of the resistor body 710.

The second reason is to improve the safety of the resistor 700 during its use and to improve the stability of its properties. For example, when using the resistor 700 mounted on a printed circuit board as illustrated in FIG. 6 for an extended period of time, if the surface of the resistor body 710 is not covered by the insulation layer 742, the resistance value can be altered because the metallic alloy comprising the resistor body 710 be exposed at the surface section.

For example, when various external dust and dirt particles in the atmosphere deposit on the resistor 700, resistance value can be altered by the deposited dirt and dust particles, or in some cases, it may be conceivable that the resistor may be damaged by the dust and dirt particles touching other parts to cause shorting. Also, when the resistor 700 is used for a long period of time under severe conditions of high temperature and high humidity, resistance change can occur due to oxidation of the metal alloys constituting the resistor body 710.

However, by forming the insulation layer 742 on the surface of the resistor 700, alteration of resistance value of the resistor 700 caused by deposited dirt and dust particles can be suppressed. Also, when the resistor 700 having the insulation layers 741, 742 is used for a long period of time under high temperature and high humidity conditions, changes in the resistance value of the resistor body 710 exposed to external environment can be controlled because of the reduction in the area of exposure.

The result is that, compared with those resistor bodies having no insulation layer covering, it is possible to provide a superior resistor 700 for current measuring purposes, that has a resistor body 719 covered by the insulation layers 741, 742, which is resistant to the effects of external conditions even when it is used under adverse conditions because of the protection afforded by the insulation layers 741, 742 to provide a stable resistance value.

What is claimed is:

1. A low resistance value resistor having inlaid metal strips, the resistor comprising a resistor body of a ribbon shape comprised of a resistive alloy, the resistor body having two end portions extending in a plane, and a central portion extending in at least one plane which is parallel to and different from the plane of the end portions, and two electrodes each comprised by a metal strip having two major parallel surfaces and having a high electrical conductivity, each end portion of the resistor body having an electrode affixed thereto and inlaid in a groove in the end portion of the resistor body with a first major surface of the metal strip contacting the end portion of the resistor body so as to form a clad structure and such that a second major surface of each metal strip and a surface of the each end portion of the resistor body adjacent to the groove lie in a common plane.

2. A low resistance value resistor according to claim 1, wherein said resistive alloy comprises Cu—Ni alloys, Ni—Cr alloys, or Fe—Cr alloys.

3. A low resistance value resistor according to claim 1, wherein said metal strip comprises copper or nickel.

4. A low resistance value resistor according to claim 1, wherein said metal strip has a thickness of 10 to 500 μm.

5. A low resistance value resistor according to claim 1, wherein said metal strip is affixed to said resistive alloy by rolling and thermal diffusion bonding or junction.

* * * * *